US009975734B2

(12) United States Patent
Dold et al.

(10) Patent No.: US 9,975,734 B2
(45) Date of Patent: May 22, 2018

(54) MONITORING DEVICE AND METHOD FOR MONITORING AN ELEVATOR SUPPORT

(71) Applicant: Inventio AG, Hergiswil (CH)

(72) Inventors: Florian Dold, Root (CH); Volker Zapf, Obernau (CH)

(73) Assignee: INVENTIO AG, Hergiswil (CH)

( * ) Notice: Subject to any disclaimer, the term of this patent is extended or adjusted under 35 U.S.C. 154(b) by 363 days.

(21) Appl. No.: 14/653,299

(22) PCT Filed: Dec. 6, 2013

(86) PCT No.: PCT/EP2013/075826

§ 371 (c)(1),
(2) Date: Jun. 18, 2015

(87) PCT Pub. No.: WO2014/095430

PCT Pub. Date: Jun. 26, 2014

(65) Prior Publication Data

US 2015/0336769 A1 Nov. 26, 2015

(30) Foreign Application Priority Data

Dec. 18, 2012 (EP) ..... 12197674

(51) Int. Cl.

| | |
|---|---|
| ***B66B 1/34*** | (2006.01) |
| ***B66B 7/12*** | (2006.01) |
| ***B66B 7/06*** | (2006.01) |

(52) U.S. Cl.

CPC ..... *B66B 7/1223* (2013.01); *B66B 7/062* (2013.01); *B66B 7/064* (2013.01)

(58) Field of Classification Search

CPC ..... B66B 7/1223; B66B 7/062; B66B 7/064
USPC ..... 187/247, 391, 393; 73/158, 763, 770, 73/774, 788, 796, 862.391; 324/522, 523, 324/525, 526, 527, 391, 693, 71.1, 71.2, 324/647, 648, 691, 700, 705, 706
See application file for complete search history.

(56) References Cited

U.S. PATENT DOCUMENTS

| | | | | |
|---|---|---|---|---|
| 7,123,030 | B2 | 10/2006 | Robar et al. | |
| 7,409,870 | B2 * | 8/2008 | Stucky | B66B 7/062 73/810 |
| 8,011,479 | B2 * | 9/2011 | Stucky | B66B 7/1223 187/391 |

(Continued)

FOREIGN PATENT DOCUMENTS

| | | | |
|---|---|---|---|
| DE | 3934654 | A1 | 5/1991 |
| WO | 03059798 | A1 | 7/2003 |

(Continued)

*Primary Examiner* — Anthony Salata
(74) *Attorney, Agent, or Firm* — William J. Clemens; Shumaker, Loop & Kendrick, LLP

(57) ABSTRACT

An elevator installation includes a car and at least one support device supporting the car. The support device has a plurality of electrically conductive tensile carriers that are arranged parallel to one another and which are substantially enclosed by a casing. The elevator installation further includes a monitoring device that connects the tensile carriers or groups of the tensile carriers in an alternating configuration as electrical resistances in a measuring bridge so that electrical resistances of different tensile carriers can be compared with one another by sensing a bridge voltage.

11 Claims, 2 Drawing Sheets

(56) References Cited

U.S. PATENT DOCUMENTS

| | | | | |
|---|---|---|---|---|
| 8,807,286 | B2 * | 8/2014 | Puranen | B66B 5/0018 187/391 |
| 8,813,918 | B2 * | 8/2014 | Kocher | B66B 7/1223 187/391 |
| 9,327,941 | B2 * | 5/2016 | Dold | B66B 7/1223 |
| 9,423,369 | B2 * | 8/2016 | Fargo | B66B 7/1223 |
| 9,599,582 | B2 * | 3/2017 | Fargo | G01N 27/20 |
| 2002/0194935 | A1 | 12/2002 | Clarke et al. | |
| 2003/0121729 | A1 | 7/2003 | Heinz et al. | |

FOREIGN PATENT DOCUMENTS

| | | | |
|---|---|---|---|
| WO | 2005094250 | A2 | 10/2005 |
| WO | 2012030332 | A1 | 3/2012 |

* cited by examiner

MONITORING DEVICE AND METHOD FOR MONITORING AN ELEVATOR SUPPORT

FIELD

The present invention relates to an elevator installation with a monitoring device for a support means and to a method of determining a state of a support means in an elevator installation.

BACKGROUND

In elevator installations steel cables were conventionally used as support means for supporting and/or driving an elevator car. According to a development of such steel cables belt-like support means comprising tensile carriers and a casing arranged around the tensile carriers are also used. However, such belt-like support means cannot be monitored in conventional manner, because the tensile carriers, which determine a breakage load of the support means, are not visible through the casing.

For the monitoring of such tensile carriers in belt-like support means a test current can be applied to the tensile carriers. A current flow or an amperage, a voltage, an electrical resistance or an electrical conductivity is measured in the thus-formed current circuit or in several thus-formed current circuits. A conclusion about the intact state or degree of wear of the support means can be made on the basis of a variable measured in that way. If, in particular, the diameter of a tensile carrier reduces due to breakage of individual wires or due to metallic abrasion the electrical resistance of this tensile carrier increases.

Published specification DE 3934654 A1 discloses, for example, a serial connection of all individual tensile carriers and an ammeter, wherein it is checked whether an electric current flows through the tensile carriers connected in series. It can thereby be established whether one of the tensile carriers is interrupted at some point.

Patent U.S. Pat. No. 7,123,030 B2 discloses calculation of an electrical resistance by measurement of an instantaneous voltage by means of a Kelvin bridge and comparison of the thus-determined voltage value with an input reference value.

Publication WO 2005/094250 A2 discloses temperature-dependent measurement of electrical resistance or electrical conductivity, in which different environmental and thus also presumed support-means temperatures are taken into account, which can be very different particularly in high elevator shafts.

WO 2003/059798 A2 discloses a belt-like support means for elevator installations. In that case, a conclusion about the loading of the support means and thus about loading of the car can be made by determining an electrical resistance of the tensile carriers of the support means. In addition, breakages of tensile carriers can be ascertained through the resistance measurement if an infinitely high resistance is ascertained. Use can be made of, for example, a Wheatstone measuring bridge for determination of the resistance.

However, it is disadvantageous with all these known forms of monitoring of support means that environmental influences which influence the electrical resistance of a tensile carrier are taken into consideration only to an insufficient degree. Thus, apart from temperature also other factors have an influence on the conductivity of the tensile carriers, such as, for example, magnetic fields or humidity.

The known forms of monitoring therefore do not provide reliable statements about the state of the support means.

SUMMARY

It is therefore an object of the present invention to provide a method of determining a state of a support means, which takes into consideration different environmental influences on the electrical conductivity of the tensile carriers and which is economic and robust in use. In addition, it is an object of the present invention to provide an elevator installation with a monitoring device for monitoring a support means, wherein different environmental influences on the electrical conductivity of the tensile carriers of the support means are taken into consideration in determination of a support means state.

In the first instance, for fulfilment of this object an elevator installation with a car and at least one support means is proposed, wherein the car is at least partly supported by the support means and wherein the support means comprises a plurality of mutually parallel electrically conductive tensile carriers substantially enclosed by a casing. The elevator installation further comprises a monitoring device which connects the tensile carriers or groups of tensile carriers as electrical resistances in an alternating configuration in a measuring bridge so that electrical resistances of different tensile carriers or groups of tensile carriers can be compared with one another by way of a bridge voltage.

Such an elevator installation initially appears disadvantageous because absolute values for assessment of a support means state are not made available. However, such a device makes it possible to provide a qualitative statement about the state of the tensile carriers of the support means, which is not falsified by environmental influences such as temperature, humidity or magnetic fields. This is achieved by comparison of tensile carriers exposed to substantially identical environmental influences. The state of the support means can thus be estimated better by the device proposed here.

Connection of tensile carriers as electrical resistances in a measuring bridge additionally has the advantage that an appropriate monitoring device can be produced economically and in addition is robust in use. Furthermore, a parameter which is simple to assess and in addition simple to determine is provided by the bridge voltage as an indicator for the state of the support means. Monitoring of the support means is thereby significantly simplified and falsified measurement values as well as interpretation errors can largely be excluded.

Connection of the tensile carriers or groups of tensile carriers in an alternating configuration to form electrical resistances in the measuring bridge has the advantage that each tensile carrier or each group of tensile carriers can be compared with a number of other tensile carriers or groups of tensile carriers. This increases the validity of a statement about the state of individual tensile carriers or groups of tensile carriers, because as a result defects of similar severity in different tensile carriers or groups of tensile carriers can also be reliably recognized.

In an exemplifying form of embodiment, in each instance an individual tensile carrier is connected as an electrical resistance in the measurement bridge. In that case, several tensile carriers of a single support means can be connected together in a measuring bridge or tensile carriers of different support means of the elevator installation can be connected together in a measuring bridge. Such a connection of the tensile carriers has the advantage that each individual tensile carrier of a support means can be checked with respect to its state. However, such a connection requires a series of measurements in order to check all tensile carriers of all support means of an elevator installation.

In an exemplifying form of embodiment, in each instance several tensile carriers of a support means are, as a group, connected as an electrical resistance in the measuring bridge. In that case, several groups of tensile carriers of a single support means can be connected together in a measuring bridge or groups of tensile carriers of different support means of the elevator installation can be connected together in a measuring bridge. Such a connection of the tensile carriers has the advantage that fewer measuring processes are required in order to check all tensile carriers of all support means of an elevator installation. Efficient monitoring of the support means can thus be achieved by appropriate combining of the tensile carriers into groups.

In an exemplifying form of embodiment, in each instance all tensile carriers of a support means are, as a group, connected as an electrical resistance in the measuring bridge. Such a connection of the tensile carriers has the advantage that the individual tensile carriers of a support means do not necessarily have to be individually contacted, but can be contacted as an entire group. This substantially simplifies electrical contact-making with the tensile carriers. However, it is not possible with such a form of electrical contact-making or connection of the tensile carriers to make a statement about an individual tensile carrier of a support means.

In an exemplifying form of embodiment, the tensile carriers of a group are respectively connected in series with one another and thus form an electrical resistance in the measuring bridge. In an alternative form of embodiment the tensile carriers of a group are respectively connected in parallel with one another and thus form an electrical resistance in the measuring bridge. Depending on the respective design of the support means, i.e., for example, depending on the material and the diameter of the tensile carriers of the support means, one or other form of connection can be advantageous. In that case, attention should be given to reliable recognition of damage to the tensile carriers such as to result in a change in the electrical resistance of the tensile carriers. Depending on the respective form of the measuring bridge and respective design of the tensile carriers it is here possible to optimally adapt a connection to the conditions.

In an exemplifying form of embodiment, four electrical resistances consisting of one or more tensile carriers are connected to form a Wheatstone measuring bridge. Such a Wheatstone measuring bridge has the advantage that a deviating electrical resistance can be reliably ascertained through determination of the bridge voltage. Reliable recognition of a defective tensile carrier or a group of defective tensile carriers is thereby ensured.

In an exemplifying form of embodiment, absolute electrical resistance values of the tensile carriers or groups of tensile carriers are not determinable by the monitoring device. Such a design of the monitoring device has the advantage that the monitoring device can be produced economically and in simple manner.

In addition, a method for determining a state of at least one support means in an elevator installation is proposed for fulfilling the initially set object. The elevator installation in that case comprises a car and at least one support means, wherein the car is at least partly supported by the support means and wherein the support means comprises a plurality of mutually parallel electrically conductive tensile carriers substantially enclosed by a casing. The method comprises the steps of connecting the tensile carriers or groups of tensile carriers in an alternating configuration to form electrical resistances in a measuring bridge and determining a state of the support means by comparison of the electrical resistances of the tensile carriers or groups of tensile carriers by way of a bridge voltage.

Such a method is initially disadvantageous, because absolute values for evaluation of the measurement results are not available. However, the method makes it possible to provide a qualitative statement about the state of the tensile carriers of the support means, which statement is not falsified by environmental influences such as temperature, humidity or magnetic fields. This is achieved by comparison of tensile carriers which are exposed to substantially identical environmental influences. It is thus possible to better estimate a state of the tensile carriers.

The connection of the tensile carriers or groups of tensile carriers in an alternating configuration has the advantage that through comparison of a tensile carrier or a group of tensile carriers with a larger number of tensile carriers or groups of tensile carriers it is possible to make a better statement about the state of the individual tensile carrier or group of tensile carriers.

In an exemplifying form of embodiment, in each instance individual tensile carriers form an electrical resistance in the measuring bridge. In an alternative form of embodiment in each instance several or all tensile carriers of a support means form an electrical resistance in the measuring bridge.

In an exemplifying form of embodiment, the electrical resistance of each tensile carrier or group of tensile carriers of the elevator installation is compared with electrical resistances of at least three other tensile carriers or three other groups of tensile carriers. This has the advantage that through such a method it is possible to make a sufficiently satisfactory statement about the state of a tensile carrier or a group of tensile carriers and that the tensile carriers or groups of tensile carriers can be connected to form a simple and robust Wheatstone measuring bridge. In that case, through determination of a parameter, particularly the bridge voltage, it is possible to make a statement about the state of four tensile carriers or four groups of tensile carriers. A very efficient and reliable method of determining a state of a support means in an elevator installation is thus provided here.

In an exemplifying form of embodiment absolute resistance values of the tensile carriers or groups of tensile carriers are not determined for ascertaining the state of the support means. Such a method again has the advantage that as a result it is not necessary to measure and evaluate an unnecessarily large number of parameters. This prevents the risk of measurement errors and erroneous interpretations of measurement results.

The determination, which is disclosed here, of a state of a support means or the monitoring device disclosed here can be used in different forms of elevator installations. Thus, for example, elevator installations with or without a shaft, with or without a counterweight or with different translation ratios can be used. Consequently, any belt-like support means in an elevator installation, which supports a car, can be monitored by the method or device disclosed here.

DESCRIPTION OF THE DRAWINGS

The invention is explained in more detail symbolically and by way of example on the basis of figures, in which.

DETAILED DESCRIPTION

Figure 1:
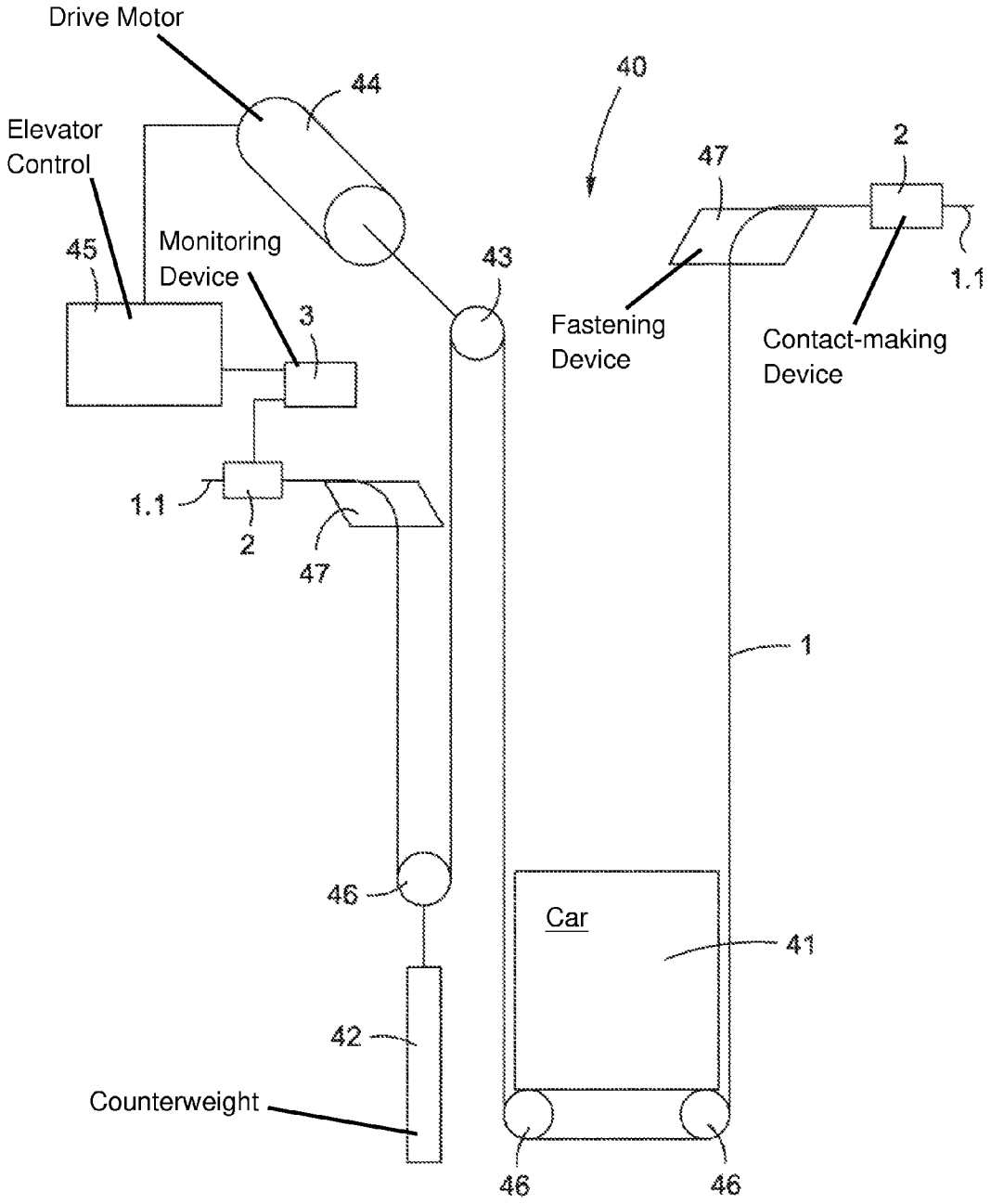
FIG. 1 shows an exemplifying form of embodiment of an elevator installation.

The elevator installation 40 illustrated schematically and by way of example in FIG. 1 includes an elevator car 41, a counterweight 42 and support device or means 1 as well as a drive pulley 43 with associated drive motor 44. The drive pulley 43 drives the support means 1 and thus moves the elevator car 41 and the counterweight 42 in opposite sense. The drive motor 44 is controlled by an elevator control 45. The car 41 is designed to receive persons or goods and transport them between floors of a building. Car 41 and counterweight 42 are guided along guides (not illustrated). In the example, the car 41 and the counterweight 42 are each suspended at support rollers 46. The support means 1 is in that case fixed to a first support means fastening device 47 and then guided initially around the support roller 46 of the counterweight 42. The support means 1 is then laid over the drive pulley 43, guided around the support roller 46 of the car 41 and finally connected by a second support means fastening device 47 with a fixing point. This means that the support means 1 runs at a higher speed, which corresponds with a suspension factor, over the drive 43, 44 than the car 41 or counterweight 42 moves. In the example the suspension factor is 2:1.

A free end 1.1 of the support means 1 is provided with a contact-making device 2 for temporary or permanent electrical contact-making with the tensile carriers and thus for monitoring the support means 1. In the illustrated example, a contact-making device 2 of that kind is arranged at both ends 1.1 of the support means 1. In an alternative form of embodiment, which is not illustrated, only one contact-making device 2 is arranged at one of the support means ends 1.1 and the tensile carriers are electrically connected together at the other support means end 1.1. The support means ends 1.1 are no longer loaded by the tensile force in the support means 1, since this tensile force is already conducted beforehand in the building by way of the support means fastening devices 47. The contact-making devices 2 are thus arranged in a region, which is not rolled over, of the support means 1 and outside the loaded region of the support means 1.

In the example, the contact-making device 2 is connected at one end of the support means 1.1 with a monitoring device 3. The monitoring device 3 in that case connects the tensile carriers of the support means 1 as electrical resistances in a measuring bridge. The electrical resistances of different tensile carriers are thereby able to be compared with one another by way of a bridge voltage ascertained by the monitoring device 3. The monitoring device 3 is additionally connected with the elevator control 45. A signal or a measurement value can thereby be transmitted from the monitoring device 3 to the elevator control 45 in order to take the state of the support means 1, as ascertained by the monitoring device 3, into consideration in a control of the elevator 40.

The illustrated elevator installation 40 in FIG. 1 is by way of example. Other suspension factors and arrangements such as, for example, elevator installations without a counterweight, are possible. The contact-making device 2 for contacting the support means 1 is then arranged in correspondence with the placement of the support means fastening devices 47.

Figure 2:
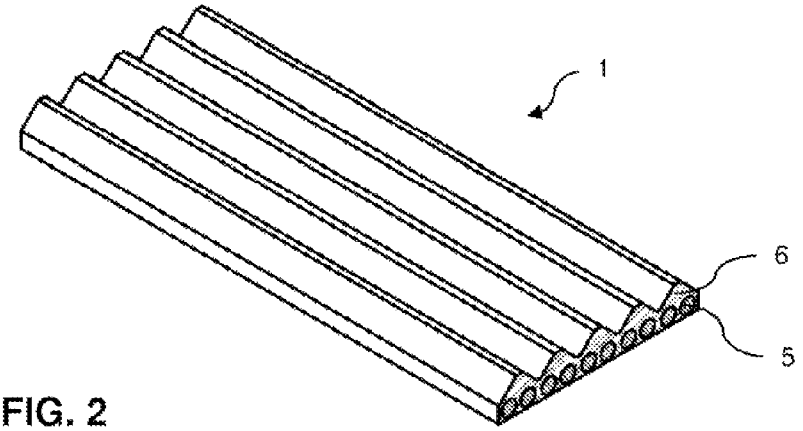
FIG. 2 shows an exemplifying form of embodiment of a support means.

A section of an exemplifying form of embodiment of a support means 1 is illustrated in FIG. 2. The support means 1 comprises a plurality of electrically conductive tensile carriers 5 which are arranged parallel to one another and enclosed by a casing 6. For the electrical contact-making of the tensile carriers 5 the casing 6 can, for example, be punctured or removed or the tensile carriers can also be electrically contacted at the end by a contact-making device 2.

In this example the support means is furnished with longitudinal ribs on a traction side. Such longitudinal ribs improve traction behavior of the support means 1 on the drive pulley 43 and additionally facilitate lateral guidance of the support means 1 on the drive pulley 43. However, the support means 1 can, however, also be of different design, for example without longitudinal ribs, or with a different number or other arrangement of tensile carriers 5. It is significant for the invention that the tensile carriers 5 are constructed to be electrically conductive.

Figure 3A:
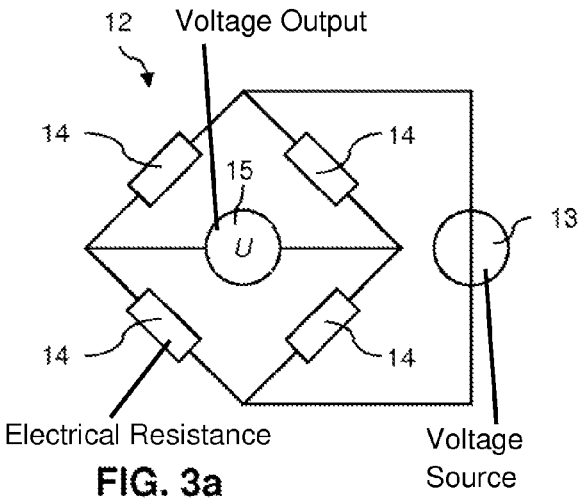
FIGS. 3*a*-3*c* each show a respective exemplifying form of embodiment of a measuring bridge.
Figure 3B:
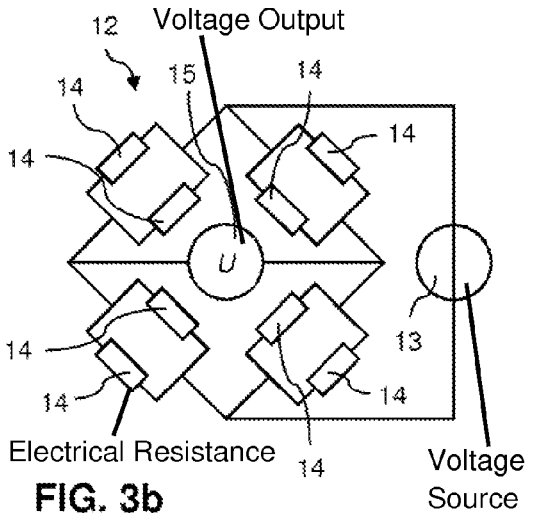
Figure 3C:
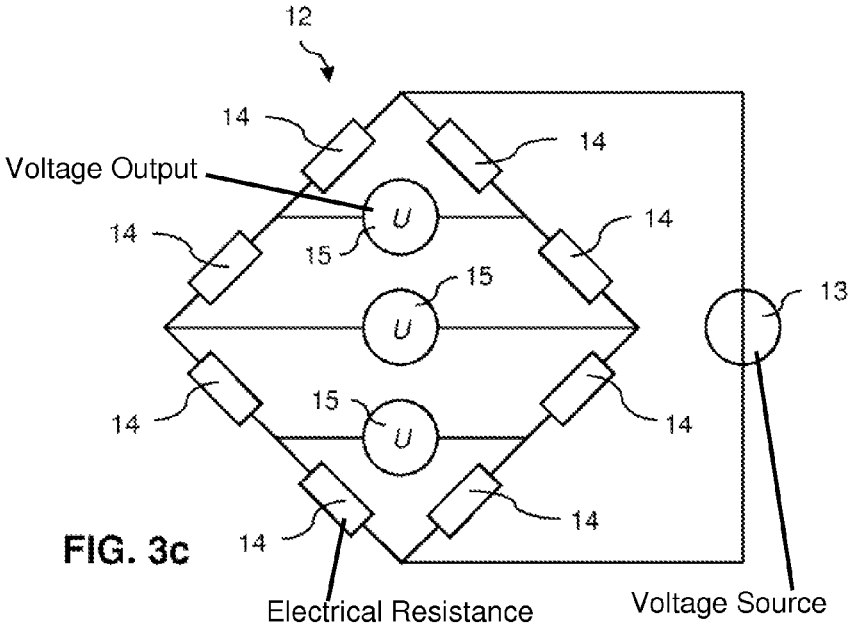

Examples of measuring bridges 12 are schematically illustrated in FIGS. 3*a* to 3*c*. In that case, respective electrical resistances 14 are connected together to form a measuring bridge 12. A voltage source 13 in that case provides an overall voltage over the measuring bridge 12 and a bridge voltage output 15 can be utilized as a parameter for equivalence or difference of the electrical resistances 14. Insofar as tensile carriers 5 of a support means 1 are used individually or in groups as electrical resistances 14 in a measuring bridge 12, information about the state of the tensile carriers 5 and thus the support means 1 can be obtained by evaluation of the bridge voltage 15.

A Wheatstone measuring bridge 12 is shown in FIG. 3*a*. Four electrical resistances 14 are in that case connected together in such a way that the bridge voltage 15 is zero when all four electrical resistances 14 are of the same magnitude. A measuring bridge 12 is illustrated in FIG. 3*b* in which in each instance two electrical resistances 14 are connected in parallel and form a bridge. A total of four such groups forms the measuring bridge 12, in which again the bridge voltage 15 can be utilized as a measure for the equivalence of the electrical resistances 14. In FIG. 3*c* a measuring bridge 12 is shown in which eight electrical resistances 14 are connected in series. A bridge voltage 15 can be determined here at several places. The bridge voltage 15 can again be utilized as a measure for the equivalence of the electrical resistances 14.

The measuring bridges shown here are examples for a suitable measuring bridge for determining a state of a support means. It will be obvious that measuring bridges of different kinds can also be used for achieving the same technical effect. For example, a three-quarters or half measuring bridge can also be used. A suitable measuring bridge can thus be selected in dependence on the respective design of the elevator installation or the support means.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation with a car supported at least partly by a support device, the support device having a plurality of electrically conductive tensile carriers arranged parallel to one another and substantially enclosed by a casing, comprising:

a monitoring device connecting the tensile carriers or groups of the tensile carriers in alternating configuration as electrical resistances in a measuring bridge wherein electrical resistances of different ones of the tensile carriers or the groups of tensile carriers are compared with one another by a bridge voltage output of the measuring bridge, wherein each tensile carrier or each group of tensile carriers is compared with a number of other tensile carriers or groups of tensile carriers.

2. The elevator installation according to claim 1 wherein each one of the tensile carriers is connected individually as one of the electrical resistances in the measuring bridge.

3. The elevator installation according to claim 1 wherein the tensile carriers are connected in groups and each group is one of the electrical resistances in the measuring bridge.

4. The elevator installation according to claim 1 wherein all of the tensile carriers of the support device are connected in a group as one of the electrical resistances in the measuring bridge.

5. The elevator installation according to claim 1 wherein the tensile carriers are connected in series with one another forming the electrical resistances in the measuring bridge.

6. The elevator installation according to claim 1 wherein the tensile carriers connected in parallel with one another forming the electrical resistances in the measuring bridge.

7. The elevator installation according to claim 1 wherein four of the electrical resistances each including at least one of the tensile carriers are connected in a Wheatstone measuring bridge.

8. A method of determining a state of a support device in an elevator installation, the elevator installation including a car supported by the support device, the support device including a plurality of electrically conductive tensile carriers arranged parallel to one another and substantially enclosed by a casing, the method comprising the steps of:

connecting the tensile carriers individually or in groups in an alternating combination to form electrical resistances in a measuring bridge; and determining a state of the support means by comparison of the electrical resistances of the tensile carriers or the groups of tensile carriers by a bridge voltage output of the measuring bridge, wherein each tensile carrier or each group of tensile carriers is compared with a number of other tensile carriers or groups of tensile carriers.

9. The method according to claim 8 wherein individual ones of the tensile carriers each form one of the electrical resistances in the measuring bridge.

10. The method according to claim 8 wherein at least two of the tensile carriers form each of the electrical resistances in the measuring bridge.

11. The method according to claim 8 wherein the electrical resistance of each of the tensile carriers or each of the groups of tensile carriers is compared with the electrical resistances of at least three other ones of the tensile carriers or three other ones of the groups of tensile carriers.

* * * * *